US009808847B2

(12) United States Patent
Rouweler et al.

(10) Patent No.: US 9,808,847 B2
(45) Date of Patent: Nov. 7, 2017

(54) METHOD AND DEVICE FOR COMPENSATING DEVIATIONS DURING A DEFORMING OPERATION BETWEEN TWO BEAMS OF A PRESS

(75) Inventors: Franciscus Wilhelmus Rouweler, Arnhem (NL); Martijn Johannes Wolbers, Hengelo (NL); Theodorus Jacobus Adrianus de Vries, Enschede (NL); Jan Peters, Apeldoorn (NL)

(73) Assignee: WILA B.V., Lochem (NL)

( * ) Notice: Subject to any disclaimer, the term of this patent is extended or adjusted under 35 U.S.C. 154(b) by 71 days.

(21) Appl. No.: 14/122,214

(22) PCT Filed: May 24, 2012

(86) PCT No.: PCT/NL2012/050368

§ 371 (c)(1),
(2), (4) Date: Jan. 17, 2014

(87) PCT Pub. No.: WO2012/165948

PCT Pub. Date: Dec. 6, 2012

(65) Prior Publication Data

US 2014/0190228 A1 Jul. 10, 2014

(30) Foreign Application Priority Data

May 26, 2011 (NL) ..... 2006854

(51) Int. Cl.
*B21D 5/02* (2006.01)
*B30B 15/00* (2006.01)

(52) U.S. Cl.
CPC ..... *B21D 5/0272* (2013.01); *B30B 15/007* (2013.01)

(58) Field of Classification Search
CPC ..... B21D 5/02; B21D 5/0209; B21D 5/0272; B21D 5/04; B21D 11/20; B30B 15/0041;
(Continued)

(56) References Cited

U.S. PATENT DOCUMENTS 5,009,098 A 4/1991 Van Merksteijn
5,269,163 A * 12/1993 Yagi ..... B30B 15/0041 100/99

(Continued)

FOREIGN PATENT DOCUMENTS

DE 3245755 A1 * 6/1984 ..... B21D 5/0272
FR 2782942 A1 3/2003

(Continued)

OTHER PUBLICATIONS

Espacenet translation of DE3245755A1 to Heinz Brand, Jun. 1984, detailed desciption and claim documents are attached.*

*Primary Examiner* — Peter DungBa Vo
*Assistant Examiner* — John S Lowe
(74) *Attorney, Agent, or Firm* — Bret E. Field; Bozicevic, Field & Francis LLP

(57) ABSTRACT

The invention relates to a method for compensating deviations in a deforming operation between two beams of a press, comprising of arranging one or more compensating element at a suitably chosen location in the press, detecting the deviations and moving the compensating element(s) relative to the beams by (electro) mechanical means during the deforming operation such that the detected deviations are compensated. The compensating elements can be moved here to an over-compensating position prior to the deforming operation and pressed out of their over-compensating position during the operation by the load on the beam, wherein each compensating element exerts an adjustable resistance force on surrounding parts of the press. It is conversely possible for the compensating elements each to be pressed stepwise to a position compensating the detected deviations during the deforming operation. It is possible to use (piezoelectric) actuators to exert the resistance force and/or to move the compensating elements. The invention
(Continued)

Figure 1:
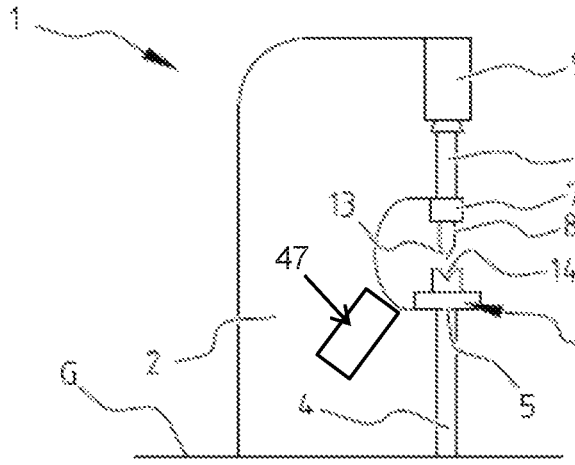

further relates to a device with which this compensation method can be performed.

21 Claims, 7 Drawing Sheets

(58) Field of Classification Search
CPC . B30B 15/007; B30B 15/0094; B29C 33/202; Y10T 29/53235; Y10T 83/8696
See application file for complete search history.

(56) References Cited

U.S. PATENT DOCUMENTS

| | | | | |
|---|---|---|---|---|
| 5,899,103 | A * | 5/1999 | Ooenoki | B21D 5/0272 72/31.1 |
| 2006/0105073 | A1* | 5/2006 | Hogenkamp | B30B 1/18 425/150 |
| 2008/0066520 | A1* | 3/2008 | Sperrer | B21D 5/0272 72/389.5 |
| 2010/0229619 | A1* | 9/2010 | Hansen | B21D 5/0272 72/386 |

FOREIGN PATENT DOCUMENTS

| | | | |
|---|---|---|---|
| JP | S59193718 | A | 11/1984 |
| JP | 62-34624 | A | 2/1987 |
| JP | 2-55622 | A | 2/1990 |
| JP | 5-44314 | U | 6/1993 |
| JP | 8-300048 | A | 11/1996 |
| JP | 2001038422 | A | 2/2001 |
| WO | WO 01/43896 | A1 | 6/2001 |
| WO | WO 2004/033125 | A1 | 4/2004 |

* cited by examiner

METHOD AND DEVICE FOR COMPENSATING DEVIATIONS DURING A DEFORMING OPERATION BETWEEN TWO BEAMS OF A PRESS

The invention relates to a method for compensating deviations in a deforming operation between two beams of a press. Such a method is known. The term "beam" is understood here to mean all possible forms of force-exerting members in presses, so not only the vertically movable beam of a press brake but for instance also the pivotable jaw of a fold-bending machine.

When a workpiece is subjected to a deforming operation between a lower beam and an upper beam of a press, for instance a press brake, deviations can occur here between the desired final shape of the workpiece and the actual final shape. These deviations can have different causes. The most important is that the upper and lower beams of the press, which are urged toward each other close to their outer ends by for instance hydraulic cylinders or servo-mechanical drives, will usually sag to some extent as a result of the force exerted for the purpose of deforming the workpiece. This is the case for both the upper beam and the lower beam, which are both usually cantilevered. The degree of deformation obtained along the length of the press varies as a result of the sagging. In addition, the tools used to deform the workpiece can show wear, whereby they do not bring about the desired degree of deformation everywhere. Finally, discontinuities may be present in the material for bending, for instance material defects, variations relative to the bending model, but also cut-away portions and the like.

Already proposed in the earlier U.S. Pat. No. 5,009,098 of applicant for the purpose of compensating these deviations is a mechanism with which a tool holder on the lower beam of a press can be bent in predetermined manner in order to follow the sagging of the upper beam. This predetermined bending is also referred to as "crowning". The older compensation or crowning mechanism is formed by two strips, the mutually facing surfaces of which have wedge-shaped protrusions. These strips are arranged between the lower beam and the lower tool holder, and are displaceable relative to each other in longitudinal direction of the lower beam. Displacing the strips in longitudinal direction causes the wedge-shaped protrusions to slide over each other so that the distance between the strips, and thereby the height of the crowning mechanism, varies. Because the wedge-shaped protrusions in the centre of the strips have a greater angle of slope than those close to the outer ends, the relative displacement will also be greater in the centre than at the ends, so that the tool holder is bent. A drive is arranged close to one of the ends of the lower beam for the purpose of displacing the strips. The protrusions can also take a wedge-shaped form in transverse direction, which provides yet another option for compensating local inaccuracies.

The known crowning mechanism has the significant drawback that it cannot be adjusted during the deforming operation, but only prior thereto. Imminent deviations cannot therefore be corrected immediately, and a number of products with deviations will first have to be made before an optimal setting is found. In addition, as a result of the variation in the angles of slope, the crowning mechanism is mainly suitable for correcting deviations in operations where the workpiece is placed centrally in the press. The degree of correction at each point of the press is moreover determined by the shape of the wedges and cannot be modified without exchanging the whole strip with wedges.

Crowning devices have already been proposed which are suitable for correcting deviations during the deforming operation. They are usually hydraulic solutions. Crowning devices are thus known with a number of hydraulic cylinders in the upper beam and/or the lower beam which compensate sagging of these beams. Devices are also known in which an oil bed is created in the upper beam and/or the lower beam, whereby a uniform pressure is obtained along the whole length of these beams.

Known from WO 2004/033125 A1 is a crowning system for use in a fold-bending machine which can compensate deviations during the fold-bending process. This known crowning system comprises two rows of wedges which lie one on the other and are arranged in the frame of the press under the lower beam. The upper row of wedges is slidable in longitudinal direction of the lower beam relative to the lower row and is connected for this purpose to two hydraulic drives on either side of the lower beam. Sagging of the lower beam can be compensated by sliding the upper row of wedges over the lower one.

The most significant drawback of these known solutions is that hydraulic systems are expensive and the extra cylinders require a relatively large amount of space. There is moreover a risk of leakage and fouling.

The invention therefore has for its object to provide a method of the above described type wherein the stated drawbacks do not occur, or at least do so to a lesser extent. According to the invention this is achieved with a method comprising the steps of arranging at least one compensation element at a suitably chosen location in the press, detecting the deviations and moving the at least one compensating element relative to the beams by (electro)mechanical means during the deforming operation such that the detected deviations are at least substantially compensated.

A deviation along the beam can be compensated by using a movable compensating element. Already compensating the deviation during the deforming operation ensures that each product is up to standard following the operation, which avoids or at least reduces waste. The use of hydraulics is avoided and a compact, clean and relatively inexpensive solution is achieved by the (electro)mechanical control of the compensating element.

In a first variant of the method according to the invention the at least one compensating element is moved to an over-compensating position prior to the deforming operation and is pressed out of its over-compensating position during the operation by the load on the beam, wherein the compensating element exerts an adjustable resistance force on surrounding parts of the press. The desired compensation can be achieved with relatively simple means by first displacing the compensating element more than necessary and then as it were "co-displacing" it with the sagging of the beam, wherein this sagging is influenced by adjusting the resistance force. The pressing force need after all only be absorbed but not overcome.

This can be realized in simple manner when the resistance force is exerted by an actuator connected to the compensating element, in particular a piezoelectric actuator.

In another variant of the method the at least one compensating element is pressed stepwise to a position compensating the detected deviations during the deforming operation. It is thus still possible, with a series of relatively small steps, for which a simple mechanism can suffice, to nevertheless compensate a considerable deviation.

It is then important here that the at least one compensating element is temporarily fixed after each step so that the desired compensation is achieved gradually.

It is also advantageous in this variant for the at least one compensating element to be pressed to the compensating position by an actuator, in particular a piezoelectric actuator.

When the at least one compensating element is arranged along or in at least one of the beams and engages thereon, and the compensating element is moved toward or away from the at least one beam during the deforming operation, a deviation can be compensated locally. This enables quick and accurate correction.

It is on the other hand also possible to envisage that at least one locally weakened part is formed in a frame of the press and the at least one compensating element is arranged at the position of the weakened frame part, and the compensating element is moved during the deforming operation such that the stiffness and/or degree of deformation of the weakened frame part is thereby adjusted. The stiffness of the whole frame, and thereby also the sagging of the beams of the press, can thus be adjusted. Because a relatively large amount of space is available in the frame, the compensating element and its drive can be given a robust form.

The invention also relates to a device with which the above described compensation method can be performed. The invention provides for this purpose a device for compensating deviations in a deforming operation between two beams of a press, comprising at least one compensating element arranged at a suitably chosen location in the press, means for detecting the deviations during the deforming operation, (electro)mechanical means for moving the at least one compensating element relative to the beams during the deforming operation, and means connected to the detection means for controlling the moving means. Using this device deviations can be automatically compensated during the deforming operation.

In a first embodiment of the compensating device according to the invention the at least one compensating element is adapted to be moved in non-loaded state to an over-compensating position and to be pressed out of its over-compensating position by a load on the beam, and the moving means are adapted to exert an adjustable resistance force on surrounding parts of the press. The press itself thus provides for the movement of the compensating element(s), and the movement only controlled and decelerated by the moving means.

It is recommended for this purpose that the moving means comprise an actuator which is connected to the at least one compensating element and which exerts the resistance force.

In an alternative embodiment of the compensating device the moving means are adapted to press the at least one compensating element stepwise to a position compensating for the detected deviations during the deforming operation. Dividing the desired movement of the compensating element into steps enables the device to nevertheless take a relatively compact form despite the great forces necessary to perform the movement during the operation.

The moving means then preferably comprise a reciprocally movable actuator for the at least one compensating element. Each reciprocal movement of the actuator can then form a step in the movement of the compensating element.

So as to be able to suffice with a relatively small and inexpensive actuator, the moving means preferably comprise a transmission placed between the compensating element and the actuator.

A structurally simple and robust device is obtained when the transmission defines with the compensating element a contact surface which lies at an angle relative to the direction of load and the actuator acts on the transmission substantially transversely of the direction of load. A simple wedge can thus be used as transmission.

When the angle of the contact surface relative to the direction of load then corresponds substantially to the complement of the angle of friction thereof, the transmission is practically self-braking. The angle of friction is defined here transversely of the direction of load. Because the actuator then need produce little force, it is possible to suffice with a small actuator, for which purpose an electric actuator, in particular a piezoelectric actuator, can for instance be selected. This is compact and efficient, but still sufficiently powerful.

The moving means are preferably adapted to temporarily fix the at least one compensating element after each step so that a stepwise continuous movement is guaranteed. The moving means can for this purpose comprise a blocking member which engages on the compensating element after each step.

The blocking member preferably defines with the compensating element a contact surface which lies at an angle relative to the direction of movement thereof such that the blocking member is self-braking. It is thus possible to dispense with a separate locking of the blocking member.

When the blocking member is movable substantially transversely of the direction of movement of the compensating element and is biased to a position engaging on the compensating element, it is automatically placed under the compensating element after each step.

The moving means are preferably adapted to displace the actuator toward the at least one compensating element after each step. Use can thus be made of a compact actuator which performs only a limited reciprocal movement but which is held in continuous engagement with the compensating element by the interval displacements.

The moving means can advantageously comprise for this purpose a displacing member which performs a stroke in the direction of the compensating element after each step.

A structurally simple and compact embodiment is achieved when the displacing member is wedge-shaped and is displaceable along a sloping surface which has an angle of slope such that the displacing member is self-braking.

The displacing member is preferably biased to a rest position relatively far removed from the compensating element. The compensating element is thus not loaded in the rest position.

In a first variant of the device the at least one compensating element is arranged along or in at least one of the beams and engages thereon, while the moving means are adapted to move the compensating element toward or away from the at least one beam. This variant is suitable for local correction of deviations.

In an alternative variant of the device at least one locally weakened part is formed in a frame of the press and the at least one compensating element is arranged at the position of the weakened frame part, while the moving means are adapted to move the compensating element in order to adjust the stiffness and/or the degree of deformation of the weakened frame part.

When the device is provided with a number of compensating elements and a corresponding number of actuators, all types of deviations along the beams can be compensated. It is thus also possible to correct deviations occurring during stage bending, making multiple bends adjacently of each other in the same product on the press.

For optimal operation the device therefore has a number of blocking members and/or displacing members corresponding to the number of compensating elements.

Figure 2:
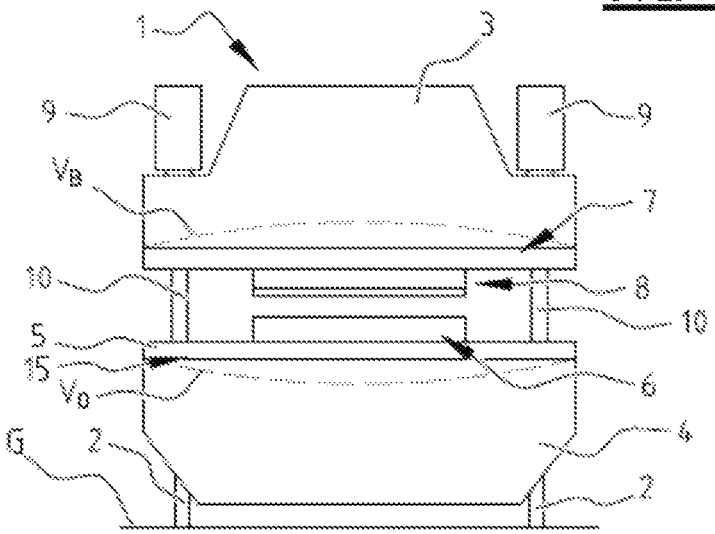
Figure 3:
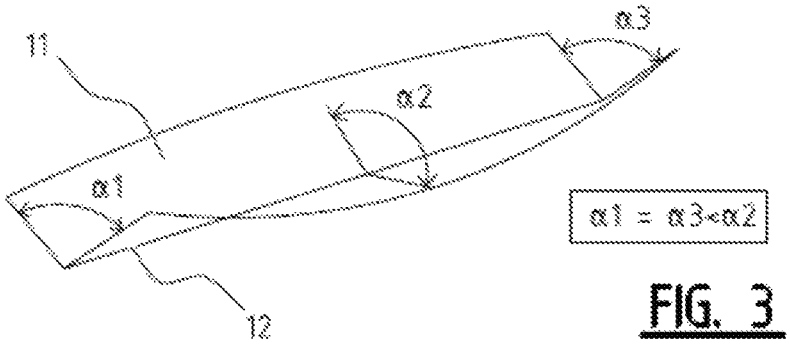
Figure 4:
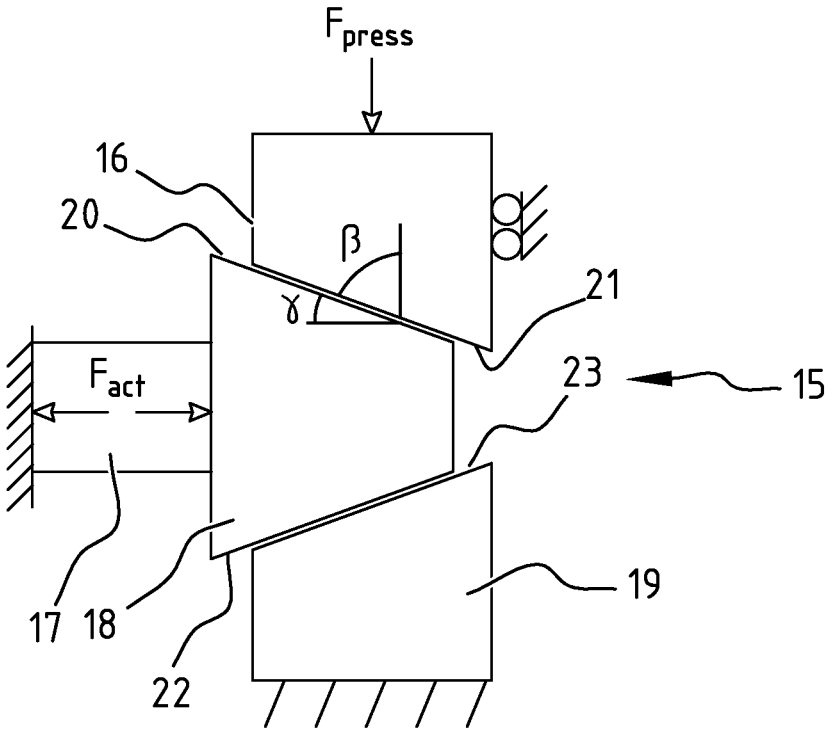
Figure 5:
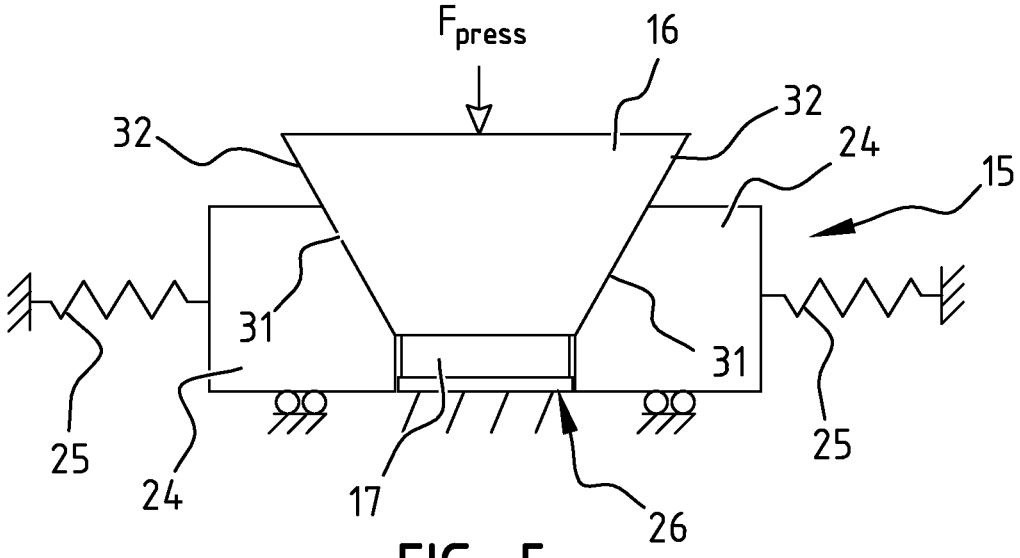
Figure 6:
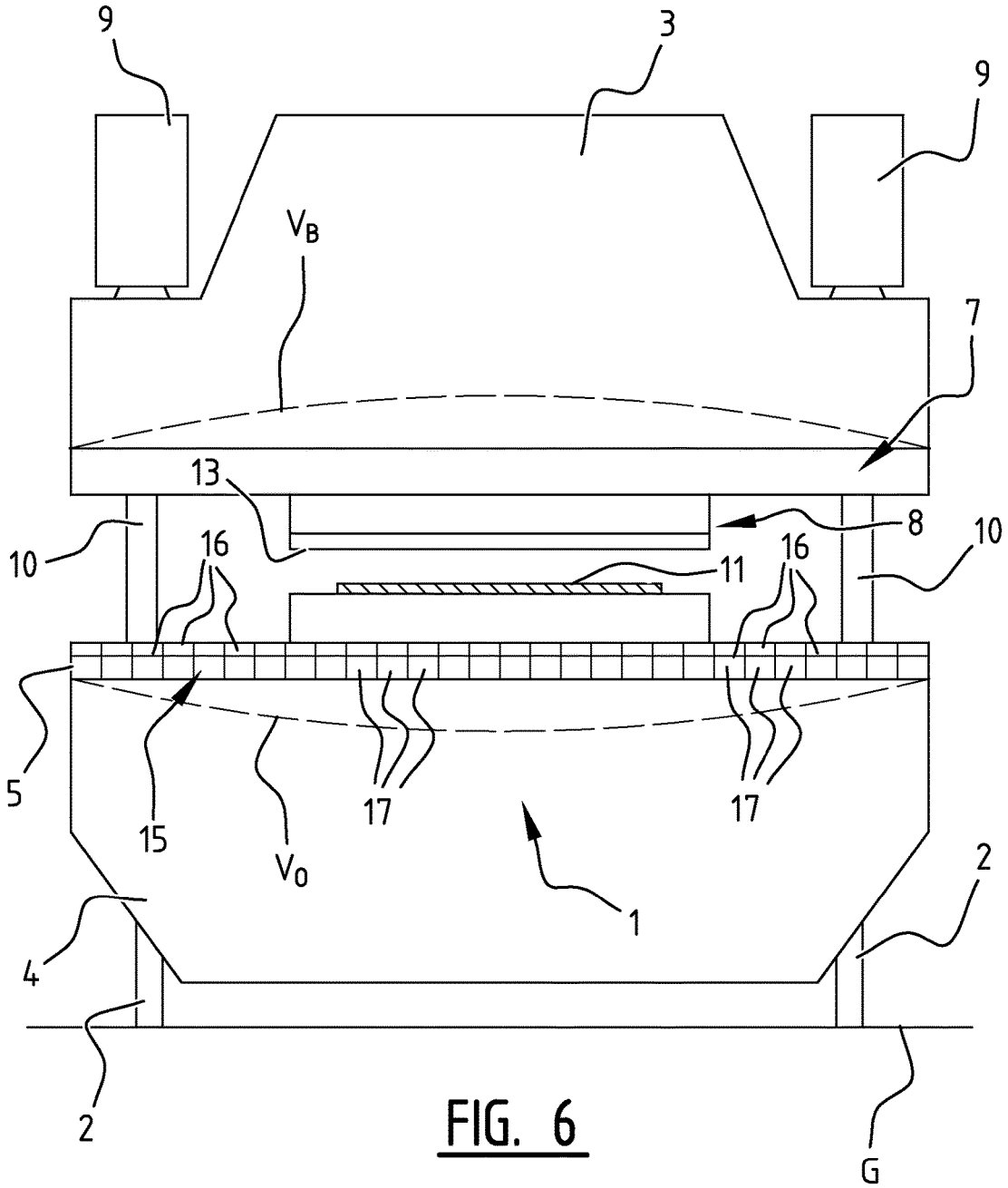
Figure 7:
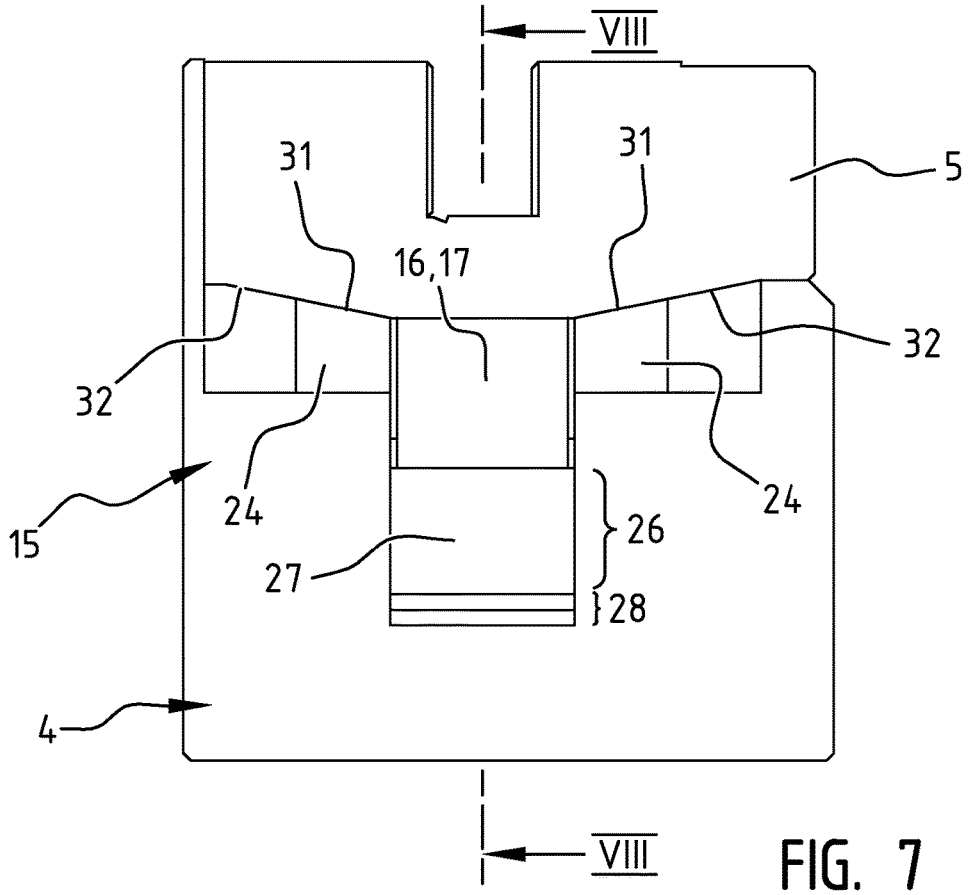
Figure 8:
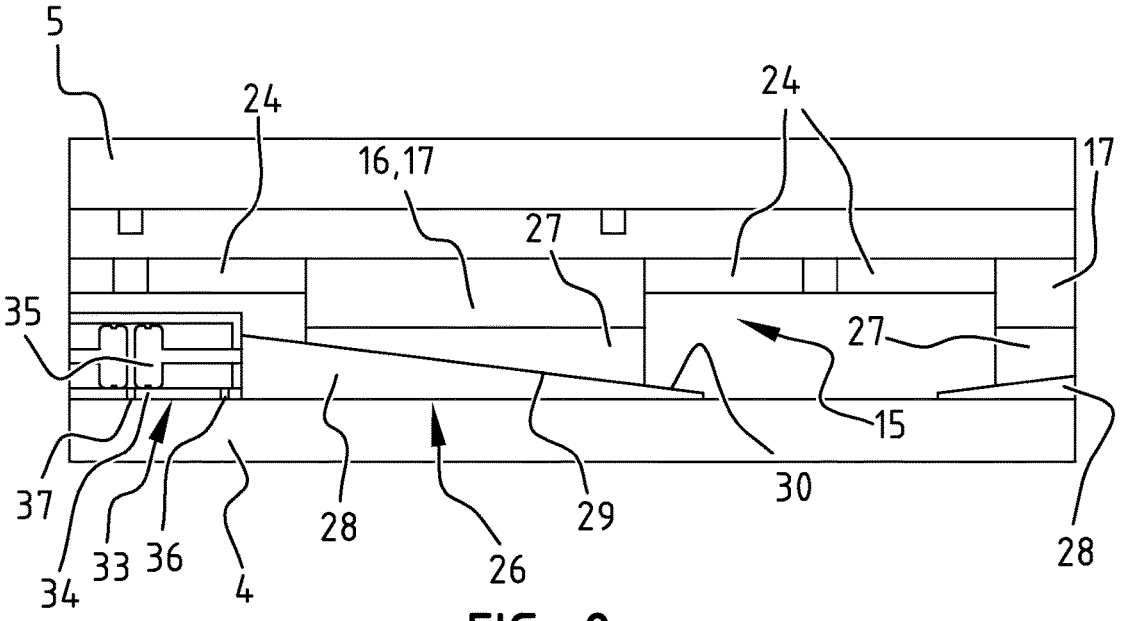
Figure 9:
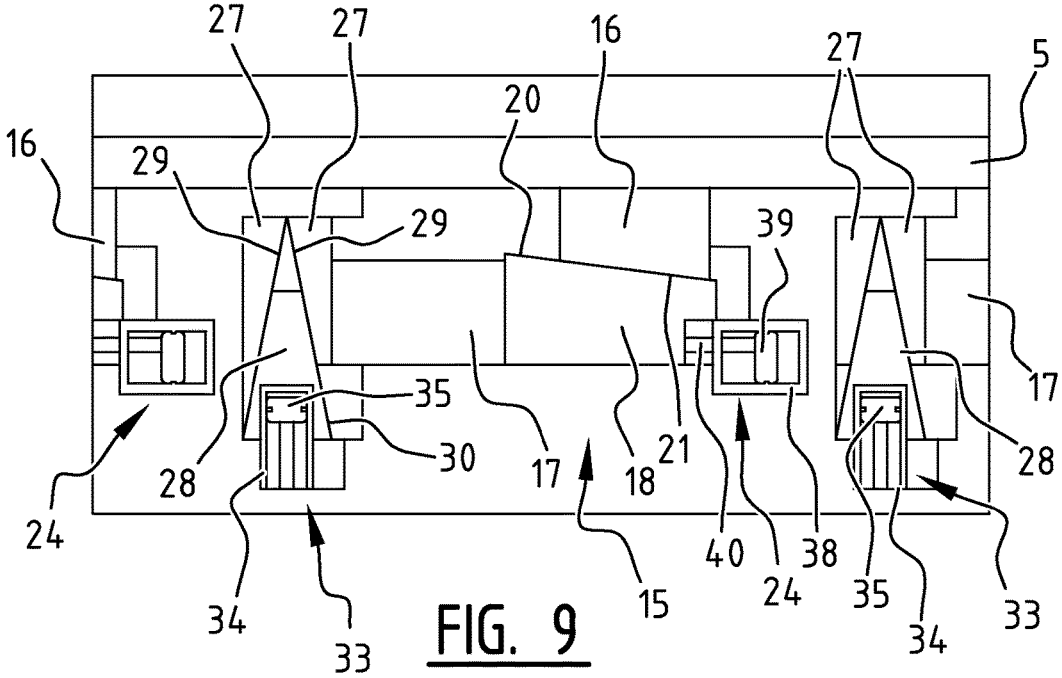
Figure 10:
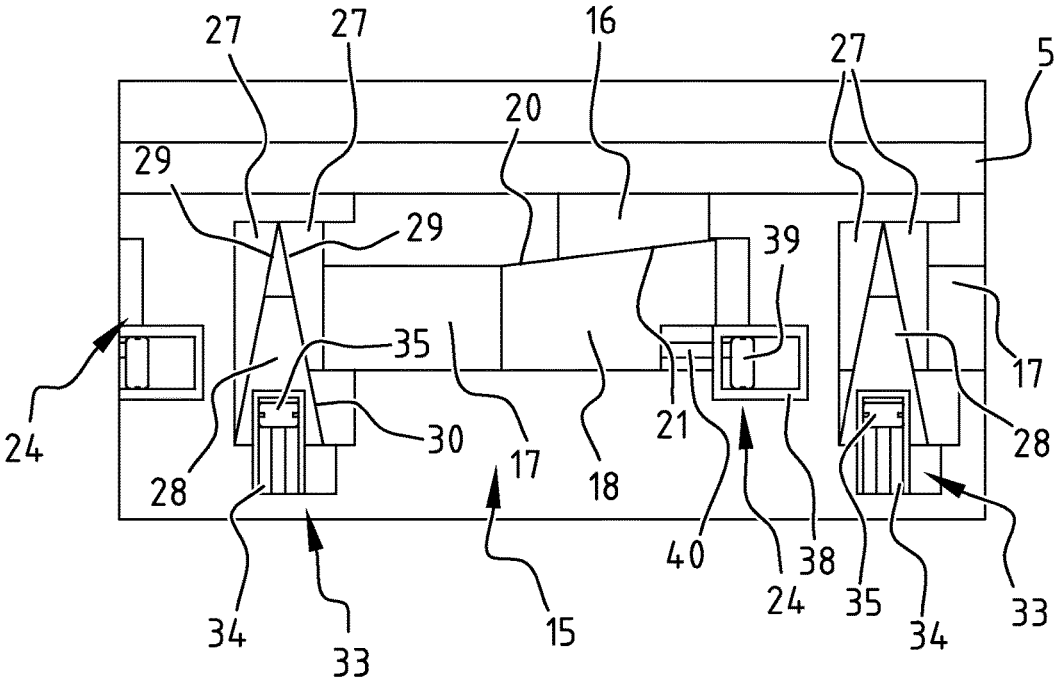
Figure 11:
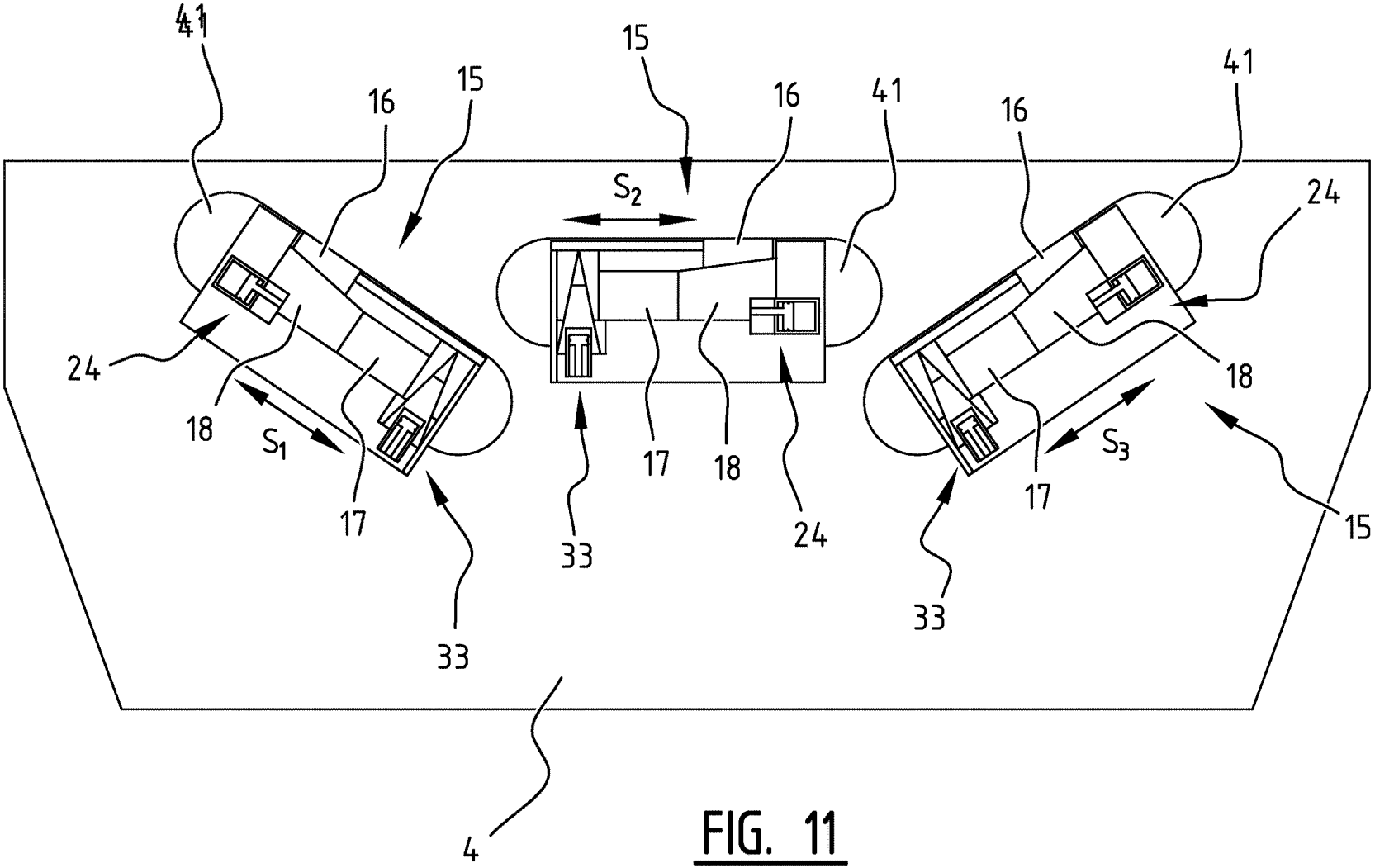
Figure 12:
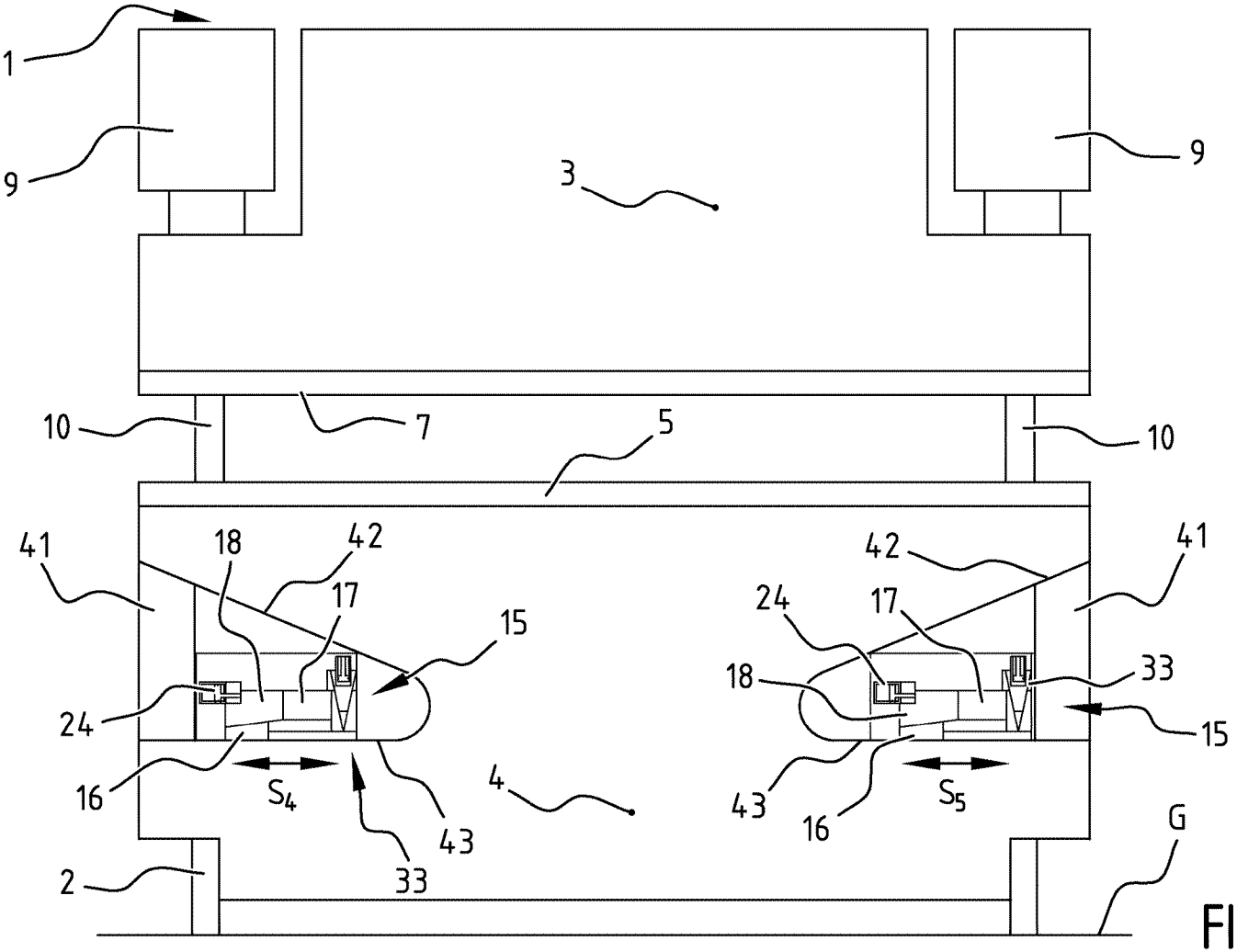

The invention will now be elucidated on the basis of a number of embodiments, wherein reference is made to the accompanying drawings in which corresponding components are designated with the same reference numerals, and in which:

FIG. 1 is a schematic side view of a press brake with an upper beam and a lower beam, FIG. 2 is a schematic front view of the press brake of FIG. 1, FIG. 3 is a perspective view of a workpiece which is bent in the press brake of FIGS. 1 and 2 and has deviations, FIG. 4 is a schematic view of the most important components of the first embodiment of the compensating device according to the invention, FIG. 5 is a schematic view of the most important components of a second embodiment of the device, FIG. 6 is a view corresponding to FIG. 2 of the press brake on a larger scale, showing a workpiece to be deformed and the compensating device, FIG. 7 shows a view corresponding to FIG. 5 of a third embodiment of the compensating device, wherein the actuator and the compensating element are formed integrally, FIG. 8 shows a cross-section along line VIII-VIII in FIG. 7, FIG. 9 and FIG. 10 show cross-sectional views corresponding to FIG. 8 of a fourth and fifth embodiment of the compensating device according to the invention, FIG. 11 shows a cross-section through a locally weakened lower beam of a press brake with the fifth embodiment of the compensating device therein, and FIG. 12 is a front view of another press brake with locally weakened lower beam and the compensating device according to FIGS. 10 and 11.

A press 1 for performing a deforming operation on, and particularly bending, a workpiece 11 comprises a frame 2 with a lower beam 4 and an upper beam 3 (FIG. 1, 2). Lower beam 4 bears a lower strip or tool holder 5 on which is mounted a lower die 6 which defines a V-shaped recess 14. Upper beam 3 bears an upper strip or tool holder 7 in which an upper die or bending tool 8 is mounted. Upper beam 3 is movable toward lower beam 4 by means of two hydraulic piston/cylinder combinations 9 close to the two outer ends of press 1. Upper beam 3 is movable here along a guide 10. A tip 13 of upper tool 8 is adapted to be pressed into recess 14 of lower die 6 when upper beam 3 is moved toward lower beam 4, whereby workpiece 11 is bent over a bending line 12 (FIG. 3).

As a result of various effects, including sagging of upper beam 3 and (to lesser extent) lower beam 4, the deforming or bending of workpiece 11 will not always be wholly uniform. Upper beam 3 and lower beam 4 will in practice curve to some extent respectively upward and downward in the centre (indicated schematically with broken lines $V_B$ and $V_0$ in FIG. 2), whereby tip 13 of upper tool 8 will penetrate less far there into recess 14 of lower die 6. This has the result that the centre of workpiece 11 will be bent less far than the outer ends thereof, so that the bending angle $\alpha 2$ will be greater there than the bending angles $\alpha 1$ and $\alpha 3$ at the ends (FIG. 3).

In order to correct this deviation the press 1 is provided with a compensating device 15. In the shown embodiment the device 15 is so compact that it is received in lower tool holder 5, although compensating device 15 could also be arranged in lower beam 4 or between lower beam 4 and lower tool holder 5. Such a compensating device 15 could also be arranged above workpiece 11 in press 1, for instance in upper beam 3, in upper tool holder 7 or between upper beam 3 and its tool holder 7.

In the shown embodiment the compensating device 15 comprises a row of compensating elements 16 placed adjacently of each other in longitudinal direction of lower beam 4 (FIG. 6). In addition, compensating device 15 comprises (electro)mechanical moving means whereby compensating elements 16 are moved toward or away from the part of lower beam 4 whose sagging has to be corrected.

In the first embodiment of device 15 the compensating elements 16 are pressed against the underside of tool holder 5 in lower beam 4 by the moving means when press 1 is not yet in use, and lower beam 4 is thus not yet loaded. Compensating elements 16 are pressed here beyond the position in which they provide an optimal compensation, so to an over-compensating position. When press 1 is activated and upper beam 3 is moved toward lower beam 4, compensating elements 16 yield in controlled manner, wherein they each exert their own resistance force on tool holder 5. The sum of the pressure force $F_{press}$ exerted by upper beam 3 and the workpiece 11 to be deformed and the resistance force exerted by compensating elements 16 is such that lower beam 4 follows the sagging of upper beam 3. This ensures that the penetration depth of upper tool 8 in lower die 6—and so also the deformation of workpiece 11—is constant along the whole length of press 1.

In this embodiment the moving means comprise an actuator 17 and a transmission 18 (FIG. 4) for each compensating element 16. In the shown embodiment the transmission 18 is formed by a wedge which is movable transversely of the direction of load of press 1. This wedge is held in place by actuator 17 which acts transversely of the direction of load. Wedge 18 has a sloping upper surface 20 which co-acts with a likewise sloping lower surface 21 of compensating element 16. The angle $\beta$ between contact surfaces 20, 21 and the direction of the load $F_{press}$ is chosen here such that its complementary angle $\gamma$—the angle of slope of upper surface 20—is only slightly greater than the angle of friction of the two surfaces 20, 21. Wedge-shaped transmission 18 is thus almost self-braking, and actuator 17 need only exert a small force $F_{act}$ in order to brake and hold compensating element 16 in place. A compact and low-power actuator 17, for instance an electric or electromechanical actuator, thus suffices to compensate the sagging resulting from the high pressure force $F_{press}$. In this embodiment the wedge 18 otherwise moves over a support element 19, which is likewise wedge-shaped in the shown embodiment. Wedge 18 and support element 19 have sloping contact surfaces 22, 23. These surfaces 22, 23 could also run horizontally as long as contact surfaces 20, 21 are sloping. These surfaces 20, 21 could on the other hand be horizontal as long as contact surfaces 22, 23 are sloping as in the shown embodiment.

In a second embodiment of device 15 the compensating elements 16 are, conversely, pressed in the direction of lower beam 4 when press 1 is operational and the full load $F_{press}$ presses thereon. This pressing under full load takes place in small steps, wherein compensating element 16 is temporarily fixed after each step. The steps are performed by a reciprocally movable actuator 17 which is held in engagement with compensating element 16 by a displacing member 26 (FIG. 5).

In the shown embodiment the actuator 17 is a piezoelectric actuator which can generate a considerable force over a relatively short stroke length with a relatively low power consumption. In order to temporarily fix compensating element 16 after each stroke of piezoelectric actuator 17, two blocking members 24 are arranged on either side of actuator 17. Each blocking member 24 has a sloping upper surface 31 co-acting with a sloping lower surface 32 of compensating element 16. Means are present (shown schematically in the shown embodiment as pressure springs 25) for the purpose of biasing blocking members 24 to an operative position in which they support compensating element 16 and relieve actuator 17. Sloping surfaces 31, 32 will in practice also form an angle with the direction of load such that blocking members 24 are self-braking.

This (slight) angle can be seen in FIG. 7, which shows a variant wherein compensating element 16 is formed integrally with actuator 17, which engages directly on the underside of lower tool holder 5. This underside has in this case a profiled form with two sloping surfaces 32, on which blocking members 24 engage, and a horizontal central part which is in engagement with the actuator 17 functioning as compensating element.

As stated, piezoelectric actuator 17 moves reciprocally (in fact up and downward) through a short stroke length, and—in the embodiment of FIG. 5—presses compensating element 16 each time a short distance in the direction of upper beam 3. In the embodiment of FIGS. 7 and 8 actuator 17 presses at each stroke against the underside of lower tool holder 5 and moves it upward to some extent. In order to ensure that each movement of actuator 17 is translated into a displacement of compensating element 16 or of lower tool holder 5, it is important that actuator 17 remains in contact with compensating element 16 or tool holder 5 under all conditions.

Provided for this purpose in the shown embodiment is displacing member 26, which consists of an upper part 27 and a lower part 28. Both parts 27, 28 are provided with co-acting, sloping surfaces 29, 30 so that a horizontal movement—as seen in the plane of the drawing—of lower part 28 results in a vertical displacement of upper part 27 and actuator 17 (FIG. 8). When actuator 17 co-acts with a compensating element 16 (FIG. 5), the latter is thus moved upward (wherein "upward" is understood to mean a movement in the direction of the opposite beam in press 1). The angle of surfaces 29, 30 is also chosen such that displacing member 26 is self-braking and so holds actuator 17 in each case in a determined position. The lower part 28 of displacing member 26 can otherwise be biased to its neutral or rest position, in which actuator 17 occupies its lowest position and exerts no force on compensating element 16.

The two parts 27, 28 of displacing member 26 are moved relative to each other by means of a drive 33. This drive 33 is formed in the shown embodiment by a piston 35 which is reciprocally movable in a cylinder 34 and which is attached with its piston rod to lower part 28. Cylinder 34, which can embodied as pneumatic or hydraulic cylinder, has connections 36, 37 on either side of piston 35 for supply or discharge of compressed air or hydraulic liquid.

In order to have the actuator 16, 17, functioning as compensating element press with a determined chosen force against the underside of lower tool holder 5, in this embodiment lower part 28 of displacing member 26 is thus first moved so far each time that upper part 27 engages on the underside of actuator 17. Actuator 17 hereby engages on the underside of tool holder 5. Actuator 17 is then activated, whereby it performs a short stroke and presses tool holder 5 locally upward in the direction of the opposite beam 3 of press 1. During this stroke the blocking members 24 move inward under the influence of the bias and thus support tool holder 5, which is thereby temporarily fixed in its upward moved position. The activation of actuator 17 is then stopped, whereby it drops back to its rest position, released from tool holder 5. Piston 35 is then moved to the right by introducing fluid, in this embodiment compressed air, into cylinder 34 via connection 37, and also presses lower part 28 of displacing member 26 to the right. Actuator 17 is thus moved upward against the bottom surface of tool holder 5, after which actuator 17 can be activated once again for the following stroke. All these movements take place under the influence of a control system which receives input signals from a detection system 47 (FIG. 1). This detection system 47 measures deviations, for instance deviations in the bent workpiece, and transmits corresponding signals to the control system, which controls actuators 17 for the purpose of correcting these deviations during pressing.

The number of compensating elements 16 and/or actuators 17 and their stroke is chosen such that the most commonly occurring deviations can be compensated. The length of each compensating element 16 or each actuator 17 would for this purpose need be no more than 200 mm, and preferably less. Deviations can be compensated in flexible manner and very accurately at a length of 50 mm. The stroke of actuators 17 and/or compensating elements 16 during pressing, i.e. under load, have to be several tenths of a millimeter. A value of 0.3 mm has been found very effective in practice. The total stroke of compensating device 5 can be in the order of 2 mm. The accuracy of the displacements has to be as great as possible. The accuracy sought in the shown embodiments is 0.005 mm.

In yet another embodiment of compensating device 15 the actuator 17 and compensating element 16 once again take a separated form, and a transmission element 18 is arranged therebetween (FIG. 9) as in the first embodiment. In this embodiment the actuator 17 is however adapted to press compensating element 16 in stepwise manner against lower tool holder 5 during the deforming operation, so in the presence of the pressure. Actuator 17 is reciprocally movable here in horizontal direction, and presses transmission element 18 slightly to the right at each stroke, whereby compensating element 16 is urged upward to some extent against the underside of tool holder 5 as a result of the co-action of the sloping contact surfaces 20, 21.

Displacing member 26 is formed in this embodiment by two wedges 27 which are non-movable in vertical direction and between which a central wedge 28 is movable up and downward. The right-hand wedge 27 is movable in horizontal direction under the influence of the vertical movement of central wedge 28, and thus holds actuator 17 in engagement with transmission element 18. The drive 33 which moves central wedge 28 upward and downward is once again formed by a (pneumatic) piston/cylinder combination 34, 35, which in this case is also oriented vertically.

The blocking at the end of each stroke of actuator 17 is provided in this embodiment by contact surfaces 20, 21, the angle of slope of which is chosen to be so small that they are self-braking. Further present in this embodiment is a second piston/cylinder combination, which can once again take a pneumatic or hydraulic form. The piston 39 of this combination, which is slidable in cylinder 38, is attached with its piston rod 40 to transmission element 18. At each stroke of actuator 17 the piston 39 co-displaces with transmission element 18, wherein fluid (air) is pressed out of cylinder 38. At the end of a stroke compressed air is supplied via connections (not shown) to cylinder 38, whereby piston 39, and thereby transmission element 18, are returned to their rest position (to the left in the drawing).

A fifth embodiment of compensating device 15 is again intended to move compensating element 16 in non-loaded state to a position in which the expected deformation of tool holder 5 is over-compensated, and to then lower it in controlled manner under the influence of the load during the deforming operation. Actuator 17 provides the necessary resistance force here so that an accurately determined end position can be reached. Transmission element 18 once again also ensures here that actuator 17 need generate only a relatively small resistance force. For the interval blocking use is once again made of the fact that contact surfaces 20, 21 between compensating element 16 and transmission element 18 are self-braking. The movement of compensating element 16 to the over-compensating position when the press brake is not yet operational is provided by the—pneumatic or hydraulic—piston/cylinder combination 38, 39, which presses transmission element 18 to the left and thereby compensating element 16 upward. When the press brake is operational and tool holder 5 is loaded, activation of actuator 17 displaces transmission element 18 through a short distance in the direction in which compensating element 16 is relieved of pressure, so here to the right. Compensating element 16 then moves slightly downward under the influence of the load on the press brake and comes to a standstill again due to the self-braking contact between surfaces 20, 21. The activation of actuator 17 is then stopped, whereby it returns to its starting position. From here the actuator 17 is once again pressed against transmission element 18 by the displacing member 26.

As stated, in the fourth and fifth embodiments the angles of contact surfaces 20, 21 between compensating element 16 and transmission element 18 on the one hand and the angles of wedge-shaped parts 27, 28 of displacing member 26 on the other are chosen such that compensating device 15 is substantially or even wholly self-braking. Only relatively small loads will thus act on the different components of compensating device 15, which can thereby take a relatively compact form.

Owing to the compact construction and the low power required by the actuators, the compensating device according to the invention is highly suitable for later incorporation into an existing press (retrofit). As stated, device 15 can be arranged in or directly under the lower tool holder 5.

It is however also possible to envisage a number of compensating devices 15 being arranged in the frame of press brake 1. FIG. 11 shows how lower beam 4 of press brake 1 is locally weakened in that recesses 41 are formed therein. Arranged at the position of these local weakened portions are compensating devices 15 which are each operatively connected between two opposite edges of recess 41. The stiffness of lower beam 4 at the position of recesses 41 can be adjusted as desired by operating compensating devices 15, whereby the deformation of lower beam 4, and so also the deformation of the tool holder 5 and lower die 6 supported thereby, can be modified. Deviations can thus be compensated without direct contact between compensating devices 15 and tool holder 5 being necessary for this purpose. Because sufficient space is available in lower beam 4, compensating devices 15 can take a larger and more robust form in this embodiment. Compensating devices 15 can further be arranged slidably in recesses 41 as according to arrows $S_1$, $S_2$, $S_3$. This increases still further the number of options for compensating detected deviations, since each compensating device 15 can be moved to a desired position prior to or during a pressing operation for the purpose of there adjusting the stiffness or degree of deformation of the frame.

In another press brake 1 recesses 41 are formed in both sides of lower beam 4, whereby the flexibility of lower beam 4 is greater close to its ends than in the centre (FIG. 12). A compensating device 15 is arranged in each of these recesses 41 between edges 42, 43 thereof. These compensating devices 15 can again also be slidable in the frame, this time as according to arrows $S_4$ and $S_5$. It is otherwise also possible to envisage both these embodiments being combined to form a lower beam 4 with recesses 41 in the side edges as well as the central part.

Although the invention is elucidated above with reference to an embodiment, it is not limited thereto. The dimensions and form of the compensating elements can thus be varied in many ways. It is also possible to apply actuators and transmissions, blocking members and/or displacing members other than those shown and described here. The straight surfaces of the different wedge-shaped elements can for instance be replaced by curved surfaces. It is also possible to envisage rotating movements, for instance a helical movement, instead of a linear movement of the compensating elements. The screw thread could then take a self-braking form as replacement for the blocking members. The placing of the compensating devices can also be modified. In addition to or instead of compensating devices in the lower beam, similar devices could also be arranged in the upper beam. The placing of the compensating devices in the lower or upper beam can for instance be related to the nature of the press, which can have a stationary lower beam and a movable upper beam (down-stroker) or, conversely, a stationary upper beam and a movable lower beam (up-stroker).

The scope of the invention is therefore defined solely by the following claims.

The invention claimed is:

1. A device for compensating deviations in a deforming operation between two beams of a press, the device comprising:

at least one compensating element arranged at a chosen location in the press, a detector for detecting the deviations during the deforming operation, an electromechanical mover adapted to move the at least one compensating element relative to the beams while under load during the deforming operation in a controlled manner, and a controller connected to the detector and adapted to control the mover so as to move the compensating element during the deforming operation;

wherein in a non-loaded state the at least one compensating element is movable by the mover in a first direction towards the opposed beam of the press and beyond an optimal compensating position to an over-compensating position; and wherein while under load the at least one compensating element yields in a controlled manner through exertion of sliding resistance forces on surrounding components of the press, said resistance being provided by a plurality of sloped contact surfaces, including slopes β and γ, respectively of the compensating element and the mover, and further those of an adjacent support element, thus the compensating element is movable by a load on the beam in a second direction to be pressed out of its over-compensating position, and the mover is adapted to exert an adjustable resistance force on the sloping contact surfaces and surrounding parts of the press.

2. The device as claimed in claim 1, wherein the mover comprises an actuator which is connected to the at least one compensating element and which exerts the resistance force.

3. A device for compensating deviations in a deforming operation between two beams of a press, the device comprising:

at least one compensating element arranged at a chosen location in the press;

a detector for detecting the deviations during the deforming operation;

an electromechanical mover adapted to move the at least one compensating element relative to the beams while under load during the deforming operation in a controlled manner; and a controller connected to the detector and adapted to control the mover so as to move the compensating element and automatically compensate deviations during the deforming operation;

wherein the mover is a reciprocally movable actuator of compact size adapted to press the at least one compensating element stepwise, thereby dividing the desired movement and the forces to perform the movement into a device of compact form that is actuated to press the at least one compensating element in a direction to a position compensating for the detected deviations during the deforming operation, and to temporarily fix the at least one compensating element after each step in association with respective mover members.

4. The device as claimed in claim 2, wherein the mover comprises a transmission placed between the compensating element and the actuator.

5. The device as claimed in claim 4, wherein the transmission defines with the compensating element a contact surface which lies at an angle relative to the direction of load and the actuator acts on the transmission substantially transversely of the direction of load.

6. The device as claimed in claim 5, wherein the angle of the contact surface relative to the direction of load corresponds substantially to the complement of the angle of friction thereof.

7. The device as claimed in claim 2, wherein the actuator is an electric actuator.

8. The device as claimed in claim 3, wherein the mover comprises a blocking member which engages on the compensating element after each step.

9. The device as claimed in claim 8, wherein the blocking member defines with the compensating element a contact surface which lies at an angle relative to the direction of movement thereof such that the blocking member is self-braking.

10. The device as claimed in claim 8, wherein the blocking member is movable substantially transversely of the direction of movement of the compensating element and is biased to a position engaging on the compensating element.

11. The device as claimed in claim 3, wherein the mover is adapted to displace the actuator toward the compensating element after each step.

12. The device as claimed in claim 11, wherein the mover comprises a displacing member which performs a stroke in the direction of the compensating element after each step.

13. The device as claimed in claim 12, wherein the displacing member is wedge-shaped and is displaceable along a sloping surface which has an angle of slope such that the displacing member is self-braking.

14. The device as claimed in claim 12, wherein the displacing member is biased in a direction away from the compensating element to a rest position in which the actuator exerts no force on the compensating element.

15. The device as claimed in claim 1, wherein the at least one compensating element is arranged along or in at least one of the beams and engages thereon, and the mover is adapted to move the compensating element toward or away from the at least one beam.

16. The device as claimed in claim 1, wherein at least one locally weakened part is formed in a frame of the press and the at least one compensating element is arranged at the position of the weakened frame part, and the mover is adapted to move the compensating element in order to adjust at least one of the stiffness and the degree of deformation of the weakened frame part.

17. The device as claimed in claim 2, wherein each compensating element has its own separate actuator.

18. The device as claimed in claim 3, wherein each compensating element has its own separate actuator.

19. The device as claimed in claim 8, wherein each compensating element has its own separate blocking member.

20. The device as claimed in claim 12, wherein each compensating member has its own separate displacing member.

21. The device as claimed in claim 7, wherein the actuator is a piezoelectric actuator.

* * * * *